United States Patent [19]

Scholes

[11] 4,285,296

[45] Aug. 25, 1981

[54] LUBRICATING APPARATUS

[75] Inventor: Addison B. Scholes, Muncie, Ind.

[73] Assignee: Ball Corporation, Muncie, Ind.

[21] Appl. No.: 914,559

[22] Filed: Jun. 12, 1978

Related U.S. Application Data

[63] Continuation-in-part of Ser. No. 881,057, Feb. 24, 1978, abandoned.

[51] Int. Cl.[3] ..... B05C 1/04; B05B 5/02

[52] U.S. Cl. ..... 118/630; 118/627; 118/629; 118/638; 118/316; 184/626; 422/32

[58] Field of Search ..... 118/621, 627, 629, 630, 118/634, 638, 314, 315, 316; 184/6.26, 15 R, 15 B, 55 R, 55 A, 56, 58, 59; 427/32; 239/556–558, 338, 597

[56] References Cited

U.S. PATENT DOCUMENTS

| | | | |
|---|---|---|---|
| 2,447,664 | 8/1948 | Pegg | 118/634 |
| 2,710,589 | 6/1955 | Brunner | 118/51 |
| 2,762,331 | 9/1956 | Henderson | 118/51 |
| 2,764,508 | 9/1956 | Feick | 427/27 |
| 2,796,845 | 6/1957 | Rendel | 118/634 |
| 2,994,618 | 8/1961 | Landgraf | 427/32 |
| 3,249,553 | 5/1966 | Steinberg | 239/338 |
| 3,560,239 | 2/1971 | Facer et al. | 427/185 X |
| 3,693,582 | 9/1972 | Delcour | 118/634 |
| 3,726,701 | 4/1973 | Nishikawa et al. | 427/32 |
| 3,736,902 | 6/1973 | Glanzer | 118/316 |
| 4,066,803 | 1/1978 | Scholes et al. | 427/32 |
| 4,073,966 | 2/1978 | Scholes et al. | 427/32 |

*Primary Examiner*—Shrive P. Beck
*Attorney, Agent, or Firm*—Jenkins, Coffey, Hyland, Badger & Conard

[57] ABSTRACT

Lubricating material is applied to a fast moving strip within a vertical deposition chamber having smooth side walls and a roof slanted at an acute angle with respect to the side walls on each side of the chamber at its top. A plurality of sources of lubricating particles are spaced in each side of the deposition chamber intermediate its top and bottom. Each of the sources includes a horizontal chamber outside of the deposition chamber and opens into the deposition chamber. Each of the sources have a plurality of compressed air atomizers supplied from a supply of lubricating material in said horizontal chamber and are adapted to remove the larger particles of lubricating material from said spray and to urge the remaining smaller particles into the deposition chamber by the residual flow of compressed air from said atomizers. Lubricating particles flow slowly and without significant momentum into the deposition chamber. Electrostatic electrode means supported at each end by the end walls of said deposition chamber on each side of its central plane are connected with a source of high electrical potential to charge and deposit the randomly moving particles of lubricating material. Means adjacent the openings at the top and the bottom of the deposition chamber balance the pressure of the atmosphere within the deposition chamber so that the gas from within the chamber flows only through the opening at its bottom.

6 Claims, 11 Drawing Figures

LUBRICATING APPARATUS

This is a continuation-in-part of U.S. Patent application Ser. No. 881,057 filed Feb. 24, 1978, now abandoned.

This invention relates to method and apparatus for applying a lubricating material to a rapidly moving metal strip, and more particularly, to method and apparatus for applying non-fluid lubricating materials to such a strip.

The lubrication of rapidly moving strips has been a source of problems for a number of years. Strips moving at a rapid rate create a considerable windage which interferes with the deposition of particulate material on the surface of the strip. Because of the windage present with rapidly moving strips, it is necessary to supply to the deposition chamber a quantity of lubricating material in excess of that needed to achieve the desired coating on the strip. Where a chamber is provided around the deposition zone, the windage creates uncontrolled turbulence within the deposition chamber carrying and depositing particles of material on the surfaces of the deposition chamber. Where operation continues over long periods of time, as is common in the manufacturing of metal strip, accumulations of undeposited lubricating materials drip from the surfaces of the deposition chamber and may be deposited upon the strip, ruining the desired uniformity of the coating of lubricating material.

It is very advantageous to provide lubricated substances with a uniform distribution of spaced microscopically small particles of lubricating material. The small particles of lubricating material are most desirably spheroidal in shape and have a diameter generally less than ten microns. Such particles are preferably formed with the use of compressed air. Becuase of the quantity and rate with which such particles must be formed to achieve deposition of a satisfactory number of particles on the rapidly moving substrate, a large volume of compressed air is used in their formation and is introduced within the deposition chamber. Because of the pressure within the deposition chamber created by its accumulation, such air escapes from the openings of the deposition chamber through which the strip moves, including, surprisingly, the opening through which the rapidly moving strip enters the chamber, notwithstanding the windage created by the rapidly moving strip.

The problems associated with such apparatus have received substantial attention. For examples, see U.S. Pat. Nos. 3,726,701; 2,994,619; 2,796,845; 2,764,508; 2,762,331; 2,710,581; and 2,447,664. Additional related apparatus are disclosed in U.S. patent application Ser. No. 829,529, filed Aug. 31, 1977, now U.S. Pat. No. 4,170,193, and Ser. No. 829,804, filed Sept. 1, 1977.

This invention provides a method and apparatus capable of uniformly depositing particles of lubricating material over the entire width of a strip at a rapid rate. The apparatus minimizes dripping of undeposited lubricating material within the deposition chamber. In addition, apparatus of this invention avoids excess accumulations of undeposited lubricating material within the deposition chamber. With the invention, lubricated strip may be rapidly manufactured for extended periods of time without contamination of the plant environment with undeposited lubricating material and without interrupting production for cleaning and maintenance of the apparatus, and the strip is manufactured with a uniform distribution of lubricating particles.

Apparatus of this invention comprises means forming a vertical deposition chamber having smooth side walls and a roof slanted at an acute angle with respect to the side walls. Metal strip to be coated preferably moves through the chamber from top to bottom adjacent its central plane. A plurality of sources of lubricating particles are spaced in each side of the deposition chamber intermediate its top and bottom. Each of the sources has a plurality of compressed air atomizers supplied from a supply of lubricating material in the source of particles. The plurality of compressed air atomizers form a spray of particles of lubricating material within the source and remove the larger particles of lubricating material from the spray. The smaller particles of lubricating material are moved into the deposition chamber through the openings in the source and deposition chamber by the residual flow of compressed air from said atomizers. The plurality of sources thus introduce particles of lubricating material into the deposition chamber remote from the moving strip at a plurality of locations. Because of their small size and the slow residual flow rate of the air, such particles form a quiescent cloud of randomly moving particles. Electrostatic electrodes are electrically isolated from, but supported by, the end walls of the deposition chamber on each side of its central plane. These electrodes are connected with high electric potential to charge and distribute the randomly moving particles of lubricating material on the strip.

Means adjacent the openings to the top and the bottom of the deposition chamber balance the pressure of the atmosphere internally within the deposition chamber so that gas from within the deposition chamber flows only from the chamber through the opening at its bottom. The flow of such gas is generally the result of the accumulation of air from the plurality of compressed air atomizers. Lubricating particles carried by the gas from the deposition chamber are prevented from escaping the apparatus by an electrostatic recovery means within the duct work leading from the bottom opening of the deposition chamber. Such electrostatic recovery means can include an electrode carried within the duct work and connected with the source of voltage to charge the lubricating particles carried by the gas and urge their deposition upon the duct work interior. Heaters maintain the fluidity of the lubricating material so that it may be withdrawn from the duct work.

The side walls of the deposition chamber may be formed from a plurality of panels, each panel including electrical strip heaters to maintain an elevated temperature at the side walls in order that any undeposited lubricating material will flow along the side walls to the bottom of the deposition chamber where it may be collected and removed from the chamber. To the extent possible, all projections from the interior surface of the coating chamber are eliminated to prevent the formation of droplets which may become deposited on the moving strip.

Uniformity of deposition may be obtained across the width of the strip by grouping a plurality of atomizers of each source of lubricating materials in controllable units, each unit including a portion of the total number of atomizers in the source. By individually controlling the units which are spaced across the horizontal chamber, controllably uniform sources of lubricating particles can be provided across the width of the strip.

In this invention, the strip to which lubricating particles are to be deposited is moved rapidly through a zone of deposition defined by the openings of a vertical deposition chamber in which the lubricating particles are to be deposited on the strip. Compressed air is used to atomize liquid lubricating material into a plurality of small particles generally spheroidal in shape and having a diameter such that the particles will remain suspended in substantially quiescent atmosphere. The small lubricating particles are carried into the deposition chamber by the residual flow of the compressed air after its expansion. The particles move randomly within the deposition chamber in response to turbulent air movement within the deposition chamber until charged and deposited on the strip. Since the deposition chamber is heated, there is a tendency for gas to rise and to escape from within the chamber through the opening adjacent its top. This chimney effect and the pressure from the accumulation of atomizing air within the deposition chamber overcome the windage of a rapidly moving strip that may enter the deposition chamber. Air is introduced at the top opening to the deposition zone, adjacent the entrance through which the rapidly moving strip enters the deposition chamber, and is withdrawn from the bottom opening of the deposition zone, adjacent the exit from which the rapidly moving strip leaves the deposition chamber. The pressure at the top opening is balanced, controlling the chimney effect and the escape of the accumulation of atomization air so that gas leaves the chamber through the bottom opening, preferably the exit through which the rapidly moving strip leaves the chamber. Particles of lubricating material carried from the deposition chamber by the gas withdrawn from the deposition chamber are electrostatically deposited and recovered within a duct work leading from the deposition chamber to the outside environment.

Further features and advantages of the invention will be apparent from the following description and drawing in which.

Figure 1:
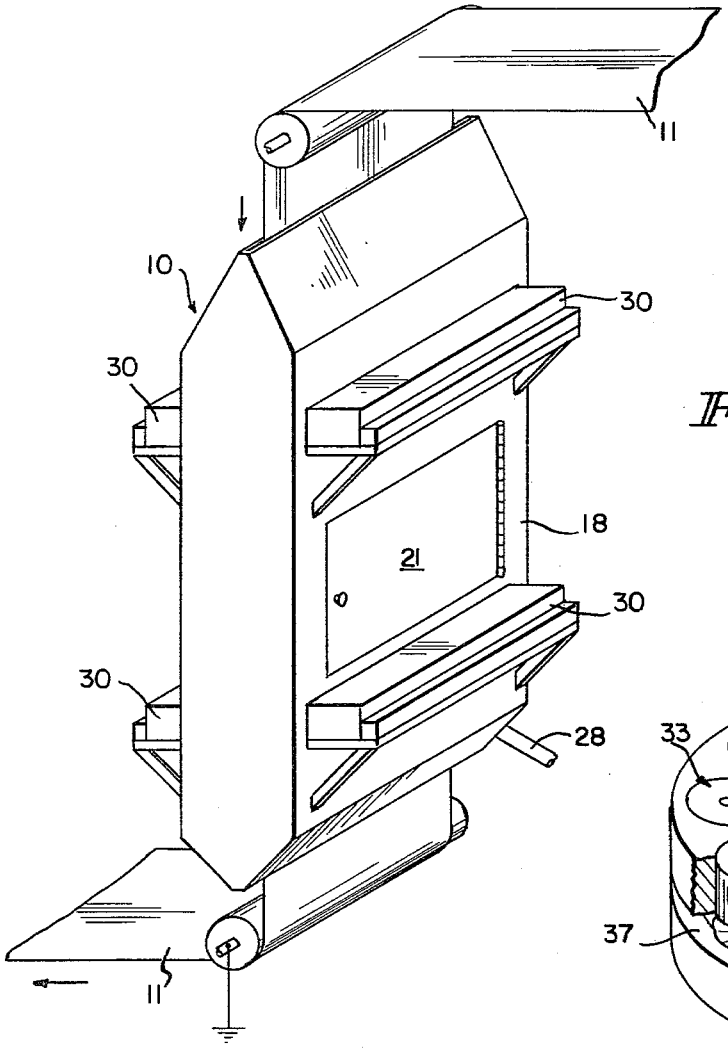
FIG. 1 is an external view of an apparatus of this invention.

FIG. 1 illustrates an apparatus 10 of this invention. The apparatus includes a structure forming a chamber for the electrostatic deposition of small particles of lubricating material to a rapidly moving strip of metal. The structure is adapted to be supported within a manufacturing facility so that strip moves vertically within the chamber. The apparatus 10 may be formed with structural steel so that it may be self-supporting when fastened to the structure of the manufacturing facility. The chamber formed within the apparatus may be enclosed with panels comprising inner, chamber-forming surfaces of fiberglass-reinforced polyester sheet and outer steel or aluminum sheets. The panels may be hinged to form doors for access to the chamber and preferably include a thermal insulation, such as fiberglass, between the inner and outer sheets and with electric surface heaters to heat the inner chamber-forming surface.

Figure 2:
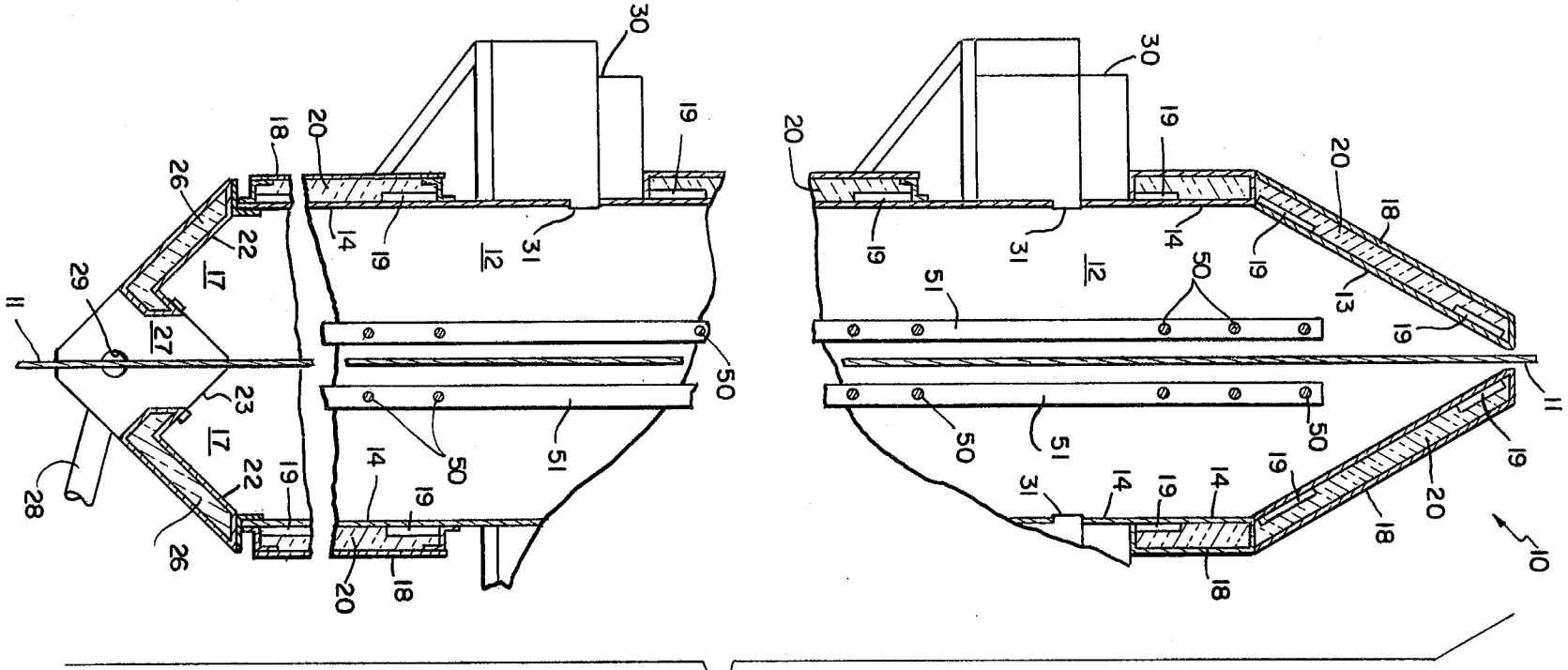
FIG. 2 is a partial cross-sectional view of the upper and lower portions of the apparatus of FIG. 1.

As illustrated in FIG. 1 and FIG. 2, a strip of metal to be lubricated 11 is moved downwardly at a rapid rate through apparatus 10 forming a coating chamber 12. A plurality of sources of lubricated particles 30 are supported by the apparatus 10. The plurality of sources of lubricating particles 30 are located, preferably, at a plurality of locations intermediate the bottom and the top of the coating chamber 12 and on each side of the path followed by the sheet 11 through the coating chamber 12. The sheet 11 preferably moves from the top to the bottom of the apparatus 10 through the coating chamber 12. As shown in FIG. 1 and FIG. 2, two sources of lubricating particles 30 may be located at each side of the sheet 11, one adjacent the top of the coating chamber on each side of the sheet and one adjacent the bottom of the coating chamber on each side of the sheet.

As indicated in FIG. 2, the sheet to be lubricated 11 passes through the coating chamber 12 along its central plane. At the top of the apparatus within the coating chamber 12, the walls 13 forming the top portion of the coating chamber 12 slope upwardly in an acute angle with respect to the vertical side walls 14 of the apparatus. Such an arrangement materially reduces dripping of lubricating material collected on the top walls of the coating chamber and unwanted deposition on the rapidly moving strip 11. Lubricating material that may collect upon sloping side walls 13 and vertical wall 14 flows downwardly along the sloping walls 13 and the vertical interior walls 14 of the coating chamber to a collection portion 17 at the bottom of the apparatus.

As shown in FIG. 2, a plurality of panels may form the walls 14 of the chamber 12. Such panels may include an inner sheet forming the sloping walls 13 and the vertical walls 14 of the coating chamber 12 and an outer sheet 18. The inner surfaces are preferably fiberglass-reinforced polyester resin sheet and carry one or more electric strip heaters 19 to maintain the inner surfaces 13 and 14 at an elevated temperature, for example on the order of 200° F. Insulating material 20, such as fiberglass, between the inner sheets and outer sheets of said panels reduce the power consumed by the electric strip heater 19 and maintain the outer sheets 18 at a safe temperature. A number of the panels may be fastened to the structure of the apparatus by hinges, as shown by hinge 21 of FIG. 1.

The collection portion 17 of chamber 12, shown in FIG. 2, is formed on each side of the chamber 12 by walls 22 and 23. The walls 22 and 23 form troughs on each side of the chamber which slant downwardly from one end of the coating chamber to the other end. The collection portion 17 is also heated by electrical strip heaters and provided with thermal insulation 26 so that the collected wax will flow to low end of each trough. Means are provided at low ends to withdraw lubricating material that may collect in the collection portion 17 of the apparatus.

In addition to forming a collection point for excess lubricating materials, the walls 22 and 23 form another exhaust manifold 27 at the bottom of the apparatus. A duct 28 is connected to the bottom exhaust manifold 27 through an opening 29. The exhaust duct 28 can be wrapped with a tape heater and thermally and electrically insulated to maintain its temperature at about 200° F.

Figure 4:
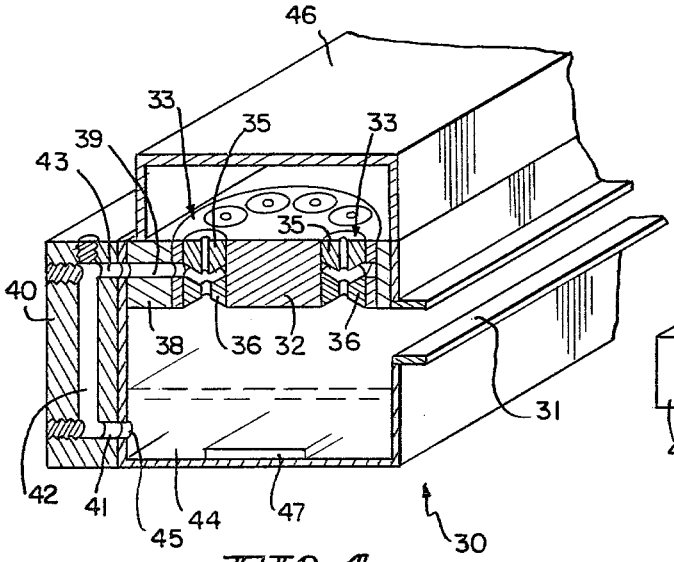
FIG. 4 is a partial cross-sectional view of the source of FIG. 3 taken through two of a plurality of compressed air atomizers included in the source.

Particles of lubricating material for deposition on the strip are formed by each source 30 of such particles in a manner to be described. The particles of lubricating material are formed by compressed air and are urged into the coating chamber 12 remotely from the strip 11 by a gentle flow of such air, after its expansion, through the elongated slot-like openings 31 of each source 30, as shown in FIG. 2 and FIG. 4. The particles once within the deposition chamber move randomly under the influence of the turbulent air within the deposition chamber until charged for deposition and form a substantially quiescent cloud of such particles on each side of the strip 11. A plurality of fine wire electrodes 50 are carried within the coating chamber 12 on each side of the central plane along which the sheet 11 moves, as shown in FIG. 2. Each electrode 50 can be a small steel wire having, for example, a diameter on the order of 0.009 inches that is carried by electrically non-conducting supports 51 mounted at each end of the apparatus within the chamber 12. The electrodes 50 can be tensioned between the supports 51 and connected together in groups within the coating chamber. Each group of electrodes 50 can be provided with means forming an electrical connection to a separate source of high potential, and the electrodes in each group can be intermingled and spaced from top to bottom within the deposition chamber so that loss of any separate source of high potential will not result in the loss of a charging and depositing field in any one section of the deposition chamber. The electrode supports 51 provide electrical isolation between the apparatus 10 and the electrode wires 50. Such electrode supports may be made of any rigid material that is not electrically conductive in the presence of high voltages, such as nylon or polypropylene. In the apparatus shown, the wire electrodes are evenly spaced six inches apart from adjacent the bottom of the chamber 12 to adjacent the top of the chamber 12 and the wire electrodes are spaced from each side of the sheet on the order of three to four inches.

Multiple high voltage supplies are used to charge the electrodes, each high voltage supply being connected to several of the electrodes comprising one group of electrodes. The high voltage supplies are capable of providing on the order of 50 kilovolts DC at 1.5 milliamps of current and can drive up to six electrodes. The electrode voltage is typically provided in an unfiltered half-wave rectified form. Because electrode supports sometimes become dirty or otherwise electrically conductive with time and are no longer able to isolate the electrodes that they support from the grounded portions of the apparatus 10, it is advisable to provide the high voltage supplies with circuitry to disconnect them from the power source is a continuous current of several milliampers is drawn from the high voltage supply. Such electrical currents will be drawn if an electrode support becomes "shorted" by a conductive path. Such circuitry will protect the high voltage supplies and because of the intermingling of the electrodes will not prevent continued operation of the apparatus.

Figure 5:
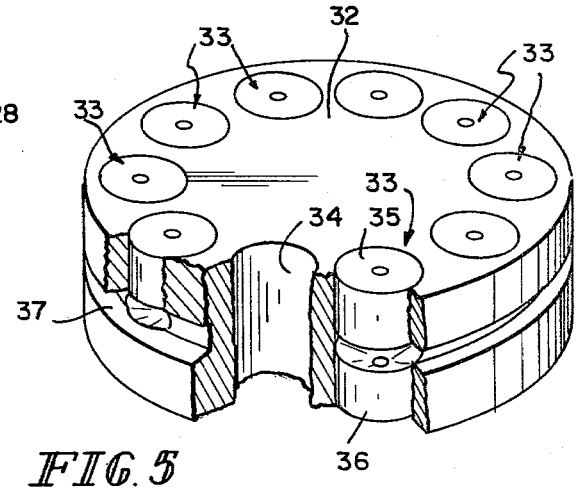
FIG. 5 is a partial cross-sectional view of one of the atomizer blocks of the source of FIG. 3 and FIG. 4.
Figure 3:
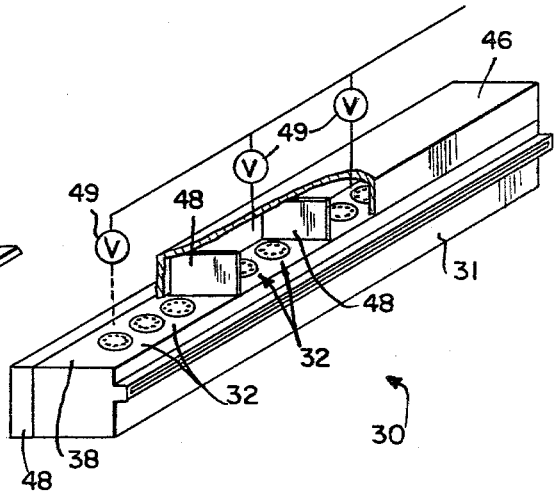
FIG. 3 is a partial cross-sectional view of the controllable source of lubricating particles for said apparatus.
Figure 7:
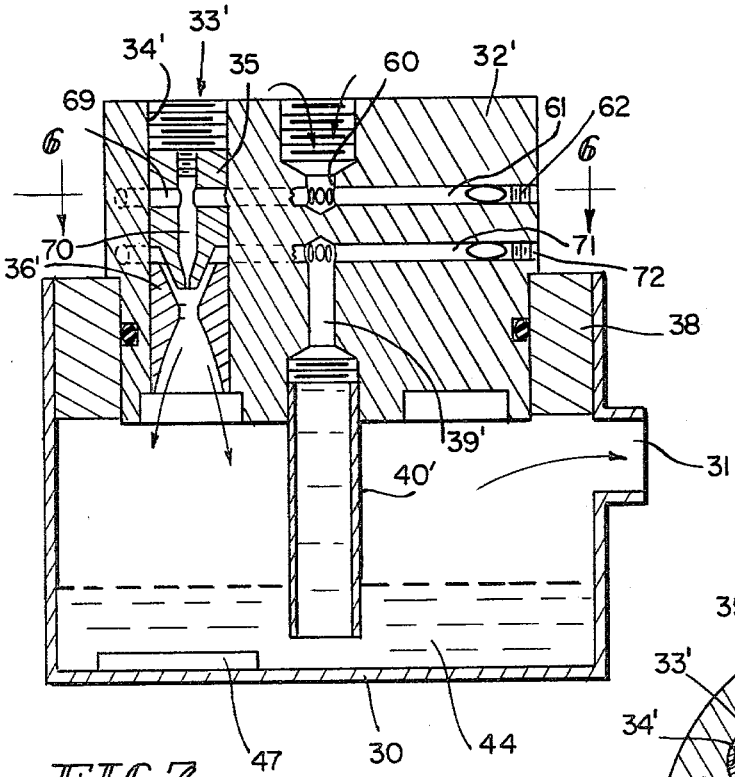
FIG. 7 is a cross-sectional view of the atomizer block of FIG. 6 and one of the plurality of compressed air atomizers.
Figure 6:
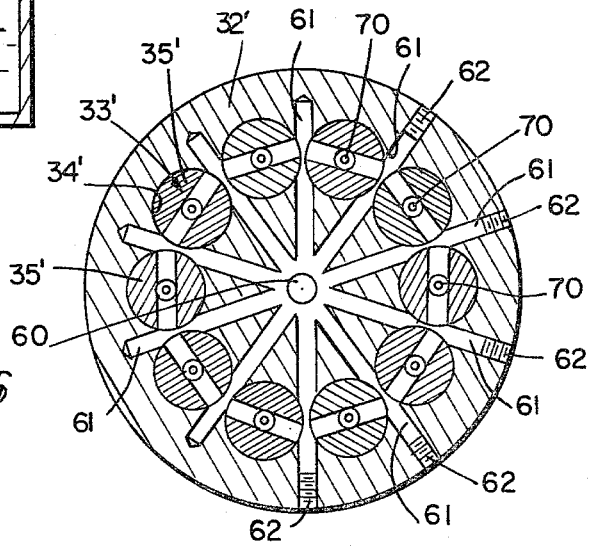
FIG. 6 is a cross-sectional view of another form of atomizer block included in a controllable source of lubricating particles.

FIG. 3 shows a source of lubricating particles 30 of the apparatus 10. FIG. 4 shows in cross section the structure of the source 30 taken through the atomizers within the source, and FIG. 5 shows in detail a block of such atomizers. FIG. 6 and FIG. 7 show another and preferred arrangement of atomizers. The source 30 extends across the extent of the coating chamber 12 as shown in FIG. 1. As shown in FIG. 3, the source includes a plurality of atomizer blocks 32, 32', typically three blocks per foot of the source.

Each atomizer block is about three inches in diameter and provides eight atomizers as shown in FIG. 5 and FIG. 6. The atomizers 33, 33' are equally spaced at 45 degree intervals adjacent the periphery of the atomizer block 32, 32'. The atomizers in such blocks are formed by providing at 45 degree intervals adjacent the periphery of the atomizer block 32, 32', eight bores 34, 34'. Each bore 34, 34' includes a nozzle forming member 35, 35' and an atomizing orifice forming member 36, 36'.

In the embodiment shown in FIG. 4 and FIG. 5, a slot 37 is formed in the periphery of the atomizer blocks 32 and intersects each of the bores 34 between the nozzle forming member 35 and the atomizing orifice forming member 36. The aluminum block 38 (as shown in FIG. 3 and FIG. 4) forming the top of the sources 30 includes a passageway 39 in communication with the slot 37 formed in the periphery of the atomizing block 32. Passage forming means 40 is attached at the side of each of the sources and provides passageways 41, 42 and 43 leading from adjacent the bottom of the source 30 to the passageways 39 and slot 37 which communicate with each of the individual atomizers 33 between the nozzle forming member 35 and the atomizing orifice forming member 36.

The bottom portion 44 of each source 30 provides a container for liquid lubricating material. A hole 45 formed in the wall of the container portion 44 of the source 30 communicates with passage forming means 40, permitting liquid lubricating material to flow to each of the atomizers 33 between the atomizing orifice forming member 36 and the nozzle forming member 35. Passage forming means 40 is sealed at the side of the source by gaskets in the manner known in the art.

In the embodiment shown in FIG. 6 and FIG. 7, as in the embodiment shown in FIG. 4 and FIG. 5, each atomizer block 32' is about three inches in diameter and provides eight atomizers. The atomizers 33' are equally spaced at 45 degree intervals adjacent the periphery of the atomizer block 32'. The atomizers 33' are formed by equally spacing adjacent the periphery of the atomizing block 32' eight threaded bores 34' in which the parts making up the atomizer are placed. Each threaded bore 34' includes a nozzle-forming member 35', and as best shown in FIG. 7, an atomizing orifice-forming member 36'. Adjacent the center of the atomizer block, at its top, a bore 60 is formed in the block 32' but does not pass entirely through the atomizer block 32'. As shown in FIG. 6, five bores 61 are formed radially through the center of the block at 45 degree intervals in such a manner that they intercept passageway 60 adjacent the center of block 32' and each of four bores 34' that lie on each side of each such bore 61. Bores 61 do not pass entirely through atomizer block 32', and bores 61 are closed at the periphery of the atomizer block by a plurality of threaded closures 62. Each of nozzle-forming members 35' includes a transverse bore 69, as shown in FIG. 7, intermediate its top and bottom in such a position that when each nozzle-forming member 35' is positioned in the bores 34', each bore 69 is in communication with one or more of bores 61, as shown in FIG. 6. A passageway is thus formed in atomizer block 32' for the passage of compressed air through passage 60 into bores 61 and through the bores 69 and into the central nozzle passageways 70 of each of nozzle-forming members 35'.

As shown in FIGS. 6 and 7, atomizer block 32' also includes adjacent its center a passageway 39' into which a passage-forming means 40' is threadably coupled. Five bores 71 (only one of which is shown in FIG. 7) are formed in atomizer block 32'. The five bores 71 are below the passageways 61 in the upper part of atomizer block 32' but are formed in the same manner that bores 61 are shown in FIG. 6. Thus, the five bores 71 are formed radially through the center of the block at 45 degree intervals in such a manner that they intercept passageway 39' and each of four adjacent bores 34' in the same manner as bores 61 in the upper portion of atomizer block 32'. Like bores 61, these five lower bores 71 do not pass entirely through atomizer block 32' and are closed at the periphery of the atomizer block by a plurality of threaded closures, as shown by closure 72 of FIG. 7. Each of these five lower bores 71 intercept bores 34' between nozzle-forming member 35' and orifice-forming member 36' as shown in FIG. 7. In operation, as compressed air flows through nozzle passageway 70 of nozzle-forming member 35', liquid lubricating material is pulled through passage-forming means 40', passageway 39', the four lower bores 71 into the space of bore 34', intermediate nozzle-forming means 35' and orifice-forming means 36' for atomization as set forth below.

Referring now to FIG. 4, a manifold 46 is attached to the top of the source 30 with an airtight gasket at the interface between the manifold 46 and the aluminum block 38. Manifold 46 forms a chamber or chambers for compressed air above the aluminum block 38 which carries the atomizer blocks 32. Compressed air is connected with the manifold 46 pressurizing the chambers formed between the manifold 46 and the plate 38. The compressed air flows through the orifices formed in each of the nozzle forming members 35 and 35' of each of the atomizers 33 or 33'. Liquid lubricating material is drawn from the tank portion 44 by the low pressure created between orifice forming member 35 or 35' and atomizing orifice forming member 36 or 36'. In the embodiment shown in FIG. 4, the liquid lubricating material flows, for example, through orifice 45, passageways 41, 42, 43, 39 and slot 37 to the intervals between the nozzle forming members 35 and atomizing orifice forming members 36 where it is forced from each of the atomizers 33 in the form of spray droplets directed downwardly at the container portion 44 of the source 30. In the embodiment shown in FIG. 7, the liquid lubricating material is drawn through passage-forming means 40' and passageway 39' and the five lower bores 71 of atomizer block 32' into the space in bores 34' between each nozzle forming member 35' and each orifice forming member 36' of each of the atomizers 33'. The liquid lubricating material is thus forced from the atomizers 33' in the form of a spray of droplets and directed down at the container portion 44 of source 30 by the action of the compressed air. Because the spray from each of the atomizers 33, 33' is directed downwardly at the container portion 44 of the source 30, larger particles formed merge into the pool of liquid lubricating material in the tank portion 44 and smaller particles are urged by a gentle residual flow of air outwardly through the elongated slot 31.

Where the lubricating material is solid wax or petrolatum at room temperature, strip heaters 47 can be mounted within the container portion 44 of each source to elevate the temperature of the container portion and liquefy the lubricating material.

In operation, each atomizer 33, 33' is capable of breaking into particulate form on the order of two pounds of molten wax in each hour of operation. Thus, with eight atomizers 33, 33' in each atomizer block 32, 32' and with three atomizer blocks for each foot of strip coated, it is possible to atomize and deliver to the coating chamber approximately 50 pounds of small lubricating particles per hour per foot of strip per source 30.

By adding dividing partitions 48 to the manifold 46, a plurality of individual compressed air chambers can be provided, each such chamber having individual flow control valves 49 to control the flow of compressed air. Such an arrangement permits the control of lubricating material particles to the strip across its entire extent.

The electrodes 50 spaced six inches apart and three inches from the grounded strip are connected to high voltage supplies capable of providing on the order of 50 kilovolts DC with approximately 200 to 300 microamperes for each electrode. With the electrodes spaced within three inchs of the strip and having a diameter of 0.009 inches, ions are created at each electrode. The fine particles of lubricating material which flow into the coating chamber 12 from each of the sources 30 are charged by the ions within the coating chamber and are predominately urged to and deposited upon the strip 11 as it moves through the chamber. That portion of the lubricating material particles which is not deposited on the strip becomes deposited upon the walls 13 and 14 of the coating chamber 12 or escapes from the chamber openings. Heating the vertical walls of the apparatus to a temperature on the order of 200° F. by electric strip heaters insures that the lubricating material deposited on the walls will flow downwardly to the bottom of the coating chamber where it may be collected. As indicated above, the bottom portion of the apparatus forms a collection portion with sloping troughs and means to withdraw the lubricating material therefrom.

It is particularly important that the interior of the coating chamber 12 have smooth walls, that is, walls free of projecting portions from which the lubricating material may drip. It is believed that because of the very low electrical conductivity of lubricating materials such as wax and petrolatum, electric charge from the ions present within the chamber will collect on the surface of the lubricating material as it forms drops but will not be dissipated from the surface and that this collected charge holds the lubricating material to the grounded surface until the weight of the lubricating material and area of the droplet in formation are such that the electrostatic force due to the collected charge is overcome. Thus, the droplets formed are large and charged when they are formed. Attraction of such large droplets to the sheet is disadvantageous to the uniformity of deposition that is wanted. Elimination of sites for the formation of such droplets is thus important to the production of quality lubricated metallic sheet. All baffles, atomizer supports and projections should thus be eliminated from the coating chamber. The openings 31 for the sources of lubricating material 30 are, to the extent possible, flush with the interior surface of the chamber. Because of their small diameter, on the order of 0.009 inches, and their electric charge, the wire electrodes do not act as sources for the formation of large droplets.

Figure 8:
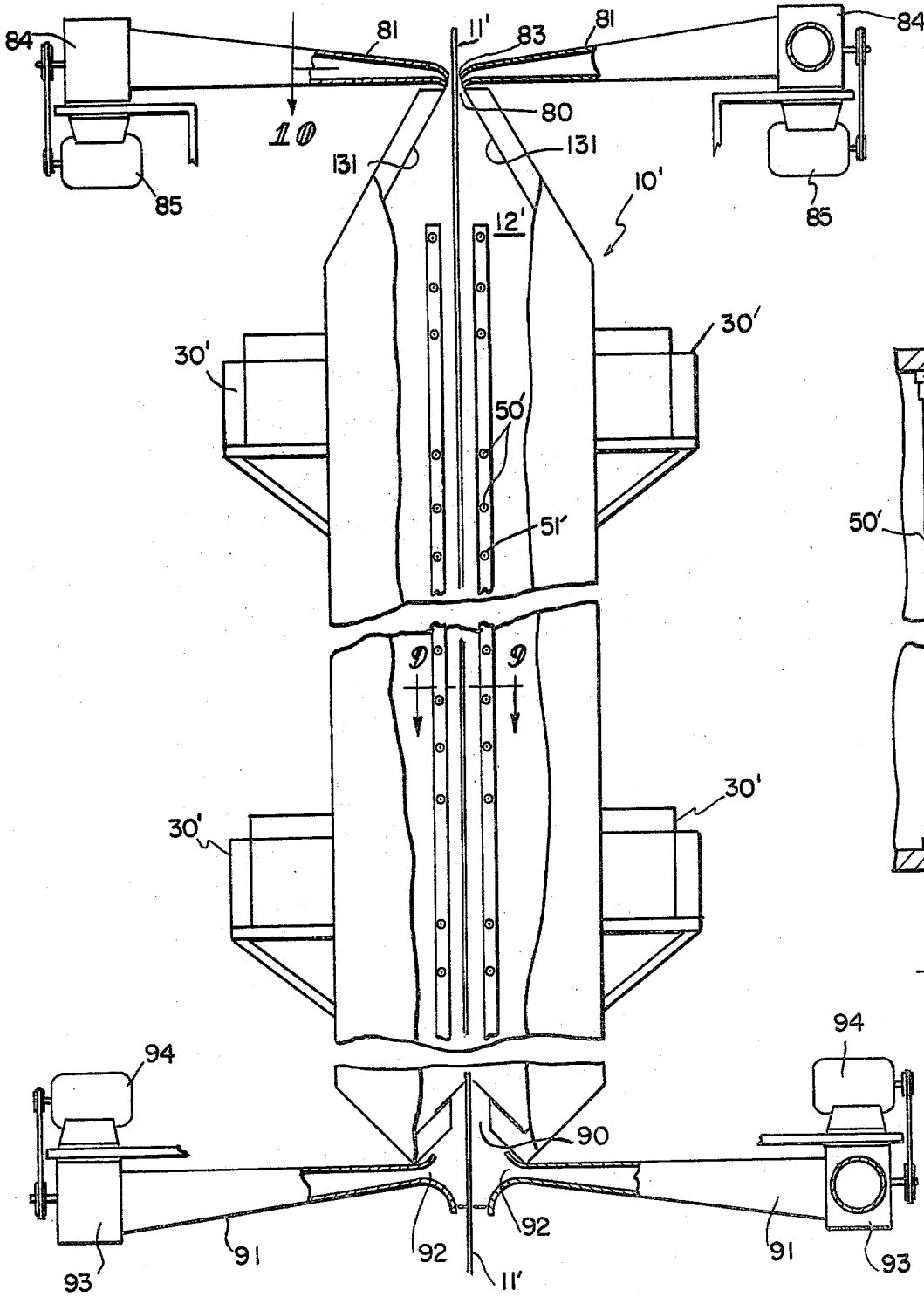
FIG. 8 is a partial cross-sectional view of an apparatus of this invention.

FIGS. 8–11 additionally illustrate this invention. As illustrated in FIG. 8, a strip of metal to be lubricated 11' is moved downwardly at a rapid rate through apparatus 10', forming a coating chamber 12'. A plurality of sources of lubricating particles 30' are supported by the apparatus 10'. The plurality of sources of the lubricating materials 30' are located, preferably, at a plurality of locations intermediate the bottom and the top of the coating chamber 12' and on each side of the path followed by the sheet 11' through the coating chamber 12'. The sheet 11' preferably moves from the top to the bottom of the apparatus 10' through the coating chamber 12'. As shown in FIG. 8, two sources of lubricating particles 30' may be located on each side of the sheet 11', one adjacent the top of the coating chamber 12' on each side of the sheet and one adjacent the bottom of the coating chamber 12' on each side of the sheet. The sheet to be lubricated 11' passes through the coating chamber 12' along its central plane. At the top of the apparatus, within coating chamber 12', the walls 13' forming the top portion of the coating chamber 12' slope upwardly at an acute angle with respect to the vertical side walls of the apparatus in the same manner shown, for example, in FIG. 2.

As in the embodiment of FIG. 2, a plurality of panels may form the walls of the coating chamber 12'. Such panels may include an inner sheet of fiberglass reinforced polyester resin and outer metal sheet with the inner sheet carrying one or more electric strip heaters to maintain the inner surface at an elevated temperature and with thermal insulating material such as fiberglass between the inner sheet and outer sheet of the panels to reduce the power consumed by the strip heater and to maintain the outer sheet at a safe temperature. Such panels may be fastened to the structure by hinges in order that they may be opened to permit access to the coated chamber 12'.

Figure 9:
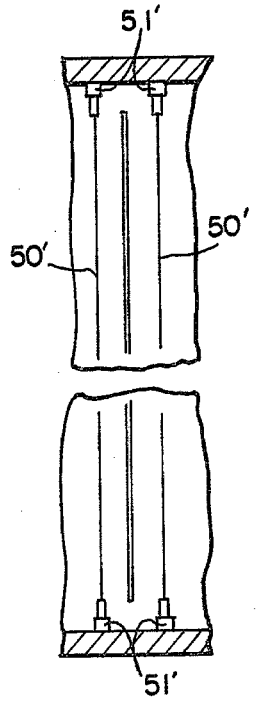
FIG. 9 is a partial cross-sectional view of the apparatus of FIG. 8, taken along lines 9—9 of FIG. 8.

Located within the deposition chamber 12' are a plurality of fine wire electrodes 50'. Each electrode 50' can be a small steel wire, having, for example, a diameter on the order of 0.009 inches. The plurality of fine wire electrodes are carried by electrically non-conductive supports 51' mounted at the ends of the apparatus 10' as shown in FIG. 9. The plurality of wire electrodes 50' are tensioned between the supports 51'. The supports 51' provide electrical isolation between the apparatus 10 and the electrode wires 50' and may be made of any rigid material that is not electrically conductive in the presence of high voltages, such as nylon or polypropylene. The electrode supports 51' have sufficient length to separate the end of the electrode wires 50' from the grounded end walls of the apparatus 10'. A distance on the order of six inches, or on the order of one inch per each ten thousand volts, on the electrode wires 50' is generally satisfactory.

Figure 10:
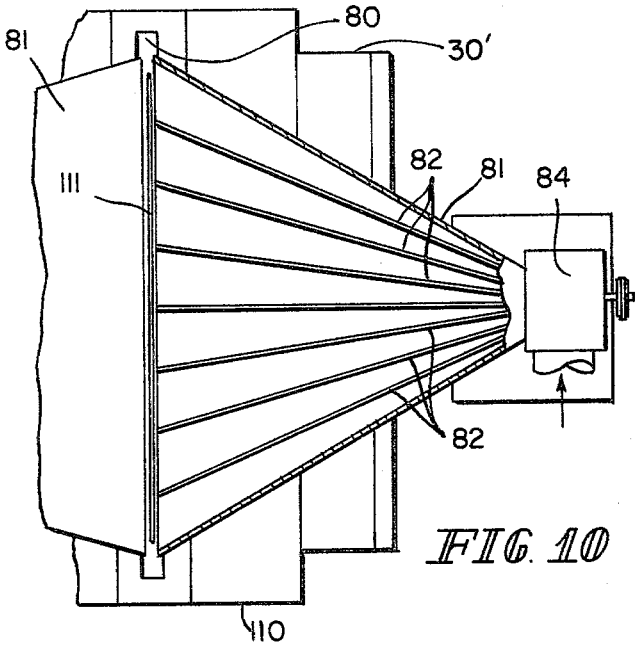
FIG. 10 is a partial cross-sectional view of FIG. 8 along line 10—10 of FIG. 8.

In the apparatus of FIG. 8, means are provided adjacent the openings at the top and the bottom of the deposition chamber to balance the pressure of the atmosphere internally within the deposition chamber so that the gas flows from the chamber only through the opening at its bottom. Such means, as shown in FIGS. 8 and 10, can include adjacent the opening 80 at the top of the deposition chamber, a duct work 81 on each side of strip 11'. The duct work 81 includes, as shown in FIG. 10, a plurality of internal partitions or dividers 82. The internal dividers 82 are spaced within the duct work 81 in such a manner that they balance the pressure at the opening 83 of the duct work uniformly across the extent of the opening 83 and the opening 80 of the deposition chamber 12'. In balancing the pressure at the upper opening into the deposition chamber to prevent escape of air from opening 80, the opening 83 of duct work 81 forms a nozzle directing a flow of air at an included angle of approximately 70 degrees with respect to the rapidly moving strip 11' as it enters the deposition zone. In order to achieve the pressure balancing effect of such means, the duct work 81 is connected at each side of the moving strip 11' to blowers 84 driven by electric motors 85 in any satisfactory manner. Separate blowers 84 are used in the preferred embodiment to permit independent adjustment of the pressure at each side of the strip 11', although in many applications of the apparatus a single source of air pressure may be connected with the duct work 81.

In operation the blowers 84 are adjusted in such a manner that a flow of air on the order of 200 feet per minute leaves the outlet openings 83 of the duct work 81. This flow of air with the windage of the rapidly moving sheet 11' prevents the escape of gas from within the deposition chamber 12' and thus prevents undeposited particles of lubricating materials from being carried upwardly from the apparatus 10 while maintaining a relatively quiescent atmosphere in the deposition zone.

Additional duct work 91 is provided adjacent the outlet opening 90 at the bottom of the deposition chamber 12' on each side of the rapidly moving sheet 11'. The duct work 91 flairs at its ends to form openings 92, the upper surfaces of which closely conform to the lower surfaces forming the opening 90 to deposition chamber 12'. The lower surfaces of openings 92 flair downwardly almost parallel with rapidly moving sheet 11'. The duct work 91 is in communication with blowers 93 driven by motors 94. The gas flowing from the opening 90 of the deposition chamber 12' is drawn into duct work 91 by the action of blowers 93. The blowers are operated so that a minimum of air is drawn into duct work 91 from outside of the apparatus 10.

Figure 11:
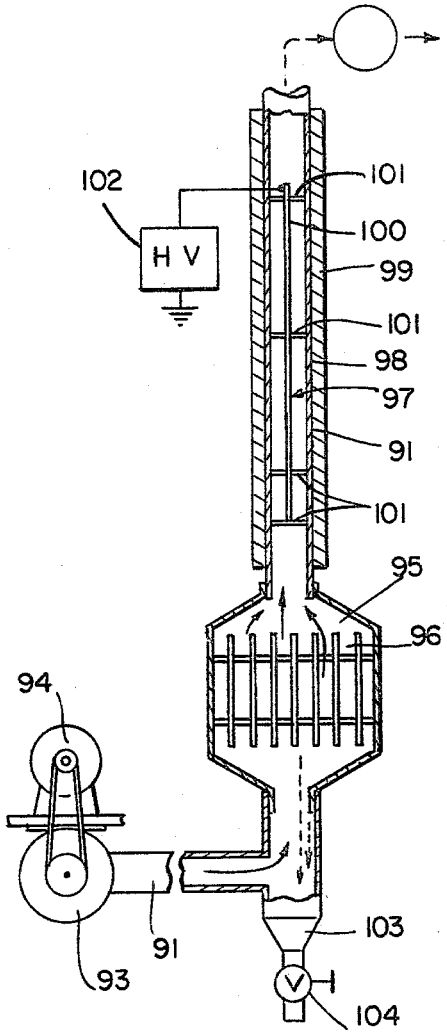
FIG. 11 is a partial cross-sectional view of duct work in communication with the bottom opening of the apparatus of FIG. 8.

Because the gas withdrawn from deposition chamber 12' by duct work 91 can carry with it undeposited lubricating particles, it is advisable to connect such a duct work with means to prevent the escape of the particles of lubricating material from the apparatus. Such means are shown in FIG. 11. As shown in FIG. 11, the duct work can include a vertically extending portion. The vertically extending portion can include a heating chamber 95 containing a heating means 96 through which the gas withdrawn from the deposition chamber is passed. The heater 96 within chamber 95 maintains the temperature of the gas within the duct work at such a temperature that the lubricating material particles remain fluid. Above the chamber 95 is a lubricating material recovery portion 97 formed by the vertically extending portion of duct work 91. At the lubricating material recovery portion 97, the duct work 91 is surrounded by heating means 98 and insulated with thermal insulating material 99 such as fiberglass. Within the duct work 91 is a wire electrode 100 preferably a steel wire having a diameter typically of 0.009 inches in diameter supported adjacent the center of the duct work 91 by electrically non-conductive supports 101. The electrode 100 is connected with a source of high voltage 102, or with the output of the high-voltage source used to energize electrodes within the deposition chamber. Particles of lubricating material are urged from the heating chamber 95 through the lubricating material recovery portion 97 by the outwardly flowing gas through the duct work 91. Within the lubricating material recovery portion 97, the particles of lubricating material are urged onto the heated walls of duct work 91. Those lubricating particles which are carried by the outwardly flowing gases past the heater 96 are deposited and flow downwardly inside duct work 91 into trap 103 as shown in FIG. 11 where they may be removed upon actuation of valve 104.

Thus, this apparatus includes means forming a vertical deposition chamber having smooth side walls, the top portion of the deposition chamber being formed with walls slanted in an acute angle with respect to the side walls. The strip to be coated is moved rapidly through the deposition chamber downwardly along its central plane. A plurality of sources of lubricating particles are spaced in each side of the deposition chamber intermediate its top and bottom. Each of the sources includes an opening into the deposition chamber through its sides and a spray of particles of lubricating material generally spheroidal in shape and having a diameter such that the particles will remain suspended in substantially quiescent atmosphere. The small particles of lubricating material are urged by the residual flow of expanded compressed air into the deposition chamber through openings in the chamber remote from the rapidly moving strip. The particles move randomly within the deposition chamber under the influence of the turbulent atmosphere caused by the rapidly moving sheet. Electrodes are electrically isolated from, but supported by, the end walls of the deposition chamber on each side of the moving strip. Because the electrodes are charged to high potential and act as a source of ions, the randomly moving particles of the lubricating material become charged and are deposited on the strip. The side walls of the deposition chamber are preferably formed from a plurality of panels, each panel including electric strip heaters to maintain an elevated temperature in the side wall so that any undeposited lubricating material will flow along the side walls to the bottom of the deposition chamber where it may be collected. These panels may be hinged to prevent access to the interior of the deposition chamber.

Uniformity of deposition can be controlled across the width of the strip by grouping a plurality of atomizers into controllable units, each unit including a portion of the total number of atomizers in the source. By individually controlling the flow of compressed air to each group of atomizers, generation of lubricating particles may be controlled across the extent of the sheet and a more uniform deposition of lubricating particles can be achieved.

Means adjacent the openings at the top and bottom of the deposition chamber balance the pressure of the atmosphere internally within the deposition chamber so that gas flows outwardly from the deposition chamber only through the opening at the bottom. This outward flow of gas is collected with a duct work adjacent the opening at the bottom of the deposition chamber, and the outwardly flowing gas and any lubricating particles carried by outwardly flowing gas are prevented from escaping the apparatus. The means to prevent the escape of lubricating materials includes heaters to maintain the fluidity of the lubricating material and electrostatic recovery means within the duct work to charge particles of lubricating materials carried with the exhaust gas and to urge their deposition within the duct work for collection and removal from the duct work. In balancing the pressure internally within the deposition chamber, the means is adjusted so that an in-flow of gas exists inwardly through the upper opening of the deposition chamber, for example, at an angle on the order of 70 degrees with respect to the rapidly moving sheet as it enters the upper opening of the deposition chamber.

The embodiment of my invention described above is capable of modification without departing from the spirit and scope of my invention as disclosed in the following claims.

I claim:

1. Apparatus for applying a lubricating material to a fast moving strip comprising means forming a vertical deposition chamber having smooth side walls, a roof slanted at an acute angle with respect to the side walls on each side of the chamber at its top, second means to move the strip rapidly through the deposition chamber along its central plane, a plurality of sources of lubricating particles spaced in each side of the deposition chamber intermediate its top and bottom, each of said sources comprising means forming a horizontal chamber outside of the deposition chamber, opening into said deposition chamber, and containing a supply of lubricating material, each of said sources having a plurality of compressed air atomizers supplied from said supply of lubricating material in said horizontal chamber and directing a spray of particles of said lubricating material particles at said supply within said horizontal chamber to remove the larger particles of lubricating material from said spray, the plurality of atomizers of each source of lubricating particles being grouped into individually controllable units, the atomizers being formed in circular blocks by providing each circular block with a plurality of bores adjacent its periphery, and providing in each bore a nozzle-forming member and an atomizing orifice member, said block having a slotted periphery with said slot communicating with the supply of lubricating material and intersecting each of said bores between said nozzle-forming member and atomizing orifice member, each controllable unit including a portion of the total number of atomizers in the source, the individually controlled units being spaced across the horizontal chamber and controllable to provide a uniform source of lubricating particles through said opening of the horizontal chamber permitting the smaller particles to be urged into the deposition chamber by the residual flow of compressed air from said atomizers, and electrostatic electrode means supported at each end by the end walls of said deposition chamber and on each side of its central plane, said electrode means being connected with a source of high electrical potential.

2. Apparatus as set forth in claim 1 wherein said side walls are formed from a plurality of panels, each panel including electrical strip heaters and providing heated side walls for the deposition chamber.

3. Apparatus for applying a lubricating material to a fast moving strip comprising means forming a vertical deposition chamber having smooth and heated side walls, and openings at the top and bottom of the deposition chamber at its central plane, second means to move the strip rapidly through the deposition chamber through the openings along its central plane, sources forming a plurality of lubricating particles by the use of compressed gas and admitting the particles to the deposition chamber through openings in each side of the deposition chamber intermediate its top and bottom, said side walls being substantially smooth at said openings, the sources of lubricating particles including a plurality of atomizers, each atomizer being formed in a circular block by providing the circular block with a plurality of bores adjacent its periphery, and providing in each bore a nozzle-forming member and an atomizing orifice member, said block having a central passageway and a plurality of radial passageways intersecting the central passageway and each of said bores between said nozzle-forming member and atomizing orifice member, third means adjacent the openings at the top and bottom of the deposition chamber to balance the pressure of the atmosphere internally within the deposition chamber so that the gas used in forming lubricating particles flows from the chamber only through the opening at its bottom, and electrostatic electrode means supported within said deposition chamber on each side of its central plane, said electrode means being connected with a source of high electrical potential.

4. Apparatus for applying a lubricating material to a fast moving strip comprising means forming a vertical deposition chamber having openings at the top and bottom of the deposition chamber at its central plane, second means to move the strip rapidly through the deposition chamber through the openings along its central plane from top to bottom, a source forming lubricating particles by the use of compressed gas in each side of the deposition chamber intermediate its top and bottom, third means adjacent the openings at the top and bottom of the deposition chamber to balance the pressure of the atmosphere internally within the deposition chamber so that the gas used in forming lubricating particles flows from the chamber only through the opening at its bottom, said third means including a duct work adjacent the opening at the top of the deposition chamber at each side of the strip connected with gas pressure-creating means to pressurize the top opening at each side of the strip, said duct work forming a nozzle-like opening on each side of the strip with the plane of the nozzle-like opening forming an angle of about 70° with respect to the strip as it enters the chamber, said duct work including internal partitions to maintain a uniform gas pressure across the opening, and electrostatic electrode means supported within said deposition chamber on each side of its central plane, said electrode means being connected with a source of high electrical potential.

5. Apparatus as set forth in claim 3 or claim 4 wherein said sides of the deposition chamber are formed from a plurality of panels, each panel including electrical strip heaters and providing heated side walls for the deposition chamber.

6. The apparatus of claim 3 or claim 4 wherein the electrostatic electrode means includes a plurality of small wire electrodes extending transversely of the deposition chamber and of the path of the strip along the central axis of the deposition chamber, and wherein several sources of high electrical potential are connected with the plurality of wire electrodes, said wire electrodes being arranged in groups of several wire electrodes to each group, each group being connected with a separate source of high electrical potential with the individual wire electrodes in each group being intermingled with the individual wire electrodes of other groups and with the individual wire electrodes of each group being spaced from top to bottom in the deposition chamber.

* * * * *

UNITED STATES PATENT AND TRADEMARK OFFICE

CERTIFICATE OF CORRECTION

PATENT NO. : 4,285,296

DATED : August 25, 1981

INVENTOR(S) : Addison B. Scholes

It is certified that error appears in the above-identified patent and that said Letters Patent are hereby corrected as shown below:

In the abstract, line 10, delete "have" and insert therefor --has--; and line 12, delete "are" and insert therefor --is--.

Col. 1, line 37, delete "Becuase" and insert therefor -- Because--.

Col. 4, line 58, delete "reduce" and insert therefor --reduces--; and line 59, delete "maintain" and insert therefor --maintains--.

Col. 5, line 66, delete "is" and insert therefor --if--.

Col. 10, line 35, delete "flairs" and insert therefor --flares--; and line 38, delete "flair" and insert therefor --flare--.

Signed and Sealed this

*Fifteenth* Day of *December 1981*

[SEAL]

*Attest:*

GERALD J. MOSSINGHOFF

*Attesting Officer*

*Commissioner of Patents and Trademarks*